US010950999B2

(12) United States Patent
Small

(10) Patent No.: US 10,950,999 B2
(45) Date of Patent: Mar. 16, 2021

(54) METHOD OF MANUFACTURING CABLE CONNECTOR HAND TOOLS

(71) Applicant: The United States of America, as represented by the Secretary of the Navy, Crane, IN (US)

(72) Inventor: Scott L. Small, Newberry, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 233 days.

(21) Appl. No.: 16/385,277

(22) Filed: Apr. 16, 2019

(65) Prior Publication Data

US 2019/0245314 A1 Aug. 8, 2019

Related U.S. Application Data

(62) Division of application No. 15/423,827, filed on Feb. 3, 2017, now Pat. No. 10,305,241, which is a division (Continued)

(51) Int. Cl.

| | |
|---|---|
| ***H01R 43/00*** | (2006.01) |
| ***H01R 43/26*** | (2006.01) |
| ***B25B 13/04*** | (2006.01) |
| ***B25B 13/50*** | (2006.01) |
| ***B25B 23/00*** | (2006.01) |
| ***H01R 13/622*** | (2006.01) |

(Continued)

(52) U.S. Cl.

CPC ..... *H01R 43/26* (2013.01); *B25B 13/04* (2013.01); *B25B 13/481* (2013.01); *B25B 13/50* (2013.01); *B25B 23/0085* (2013.01); *H01R 13/622* (2013.01); *H01R 13/6392* (2013.01); *Y10T 29/49* (2015.01); *Y10T 29/4978* (2015.01); *Y10T 29/49194* (2015.01); *Y10T 29/53209* (2015.01)

(58) Field of Classification Search

CPC .. H01R 13/622; H01R 13/6392; H01R 43/26; B25B 13/04; B25B 13/50; B25B 23/0085

See application file for complete search history.

(56) References Cited

U.S. PATENT DOCUMENTS 4,003,616 A * 1/1977 Springer ..... H01R 39/64 439/23
4,753,600 A * 6/1988 Williams ..... H01R 39/64 439/22

(Continued)

*Primary Examiner* — Paul D Kim

(74) *Attorney, Agent, or Firm* — Naval Surface Warfare Center, Crane Division; Christopher A. Monsey

(57) ABSTRACT

An illustrative cable connector hand tool and associated method are operable to permit cable connection sections to respectively pass through a side opening of hand tool members into a center aperture of the tool members. In one illustrative embodiment, the hand tool members are formed with a recessed portion adapted to receive an end of one of a pair of cable connectors such that mating edges of the cable connectors used to couple the cable connection sections are visible when the cable connectors are in a coupled configuration abutting each other. An illustrative embodiment includes the recessed portion formed with a plurality of keyway indentions or recesses spaced apart in the center aperture that are operable to engage keys, protrusions, or lugs on an outer wall of the cable connectors.

3 Claims, 13 Drawing Sheets

Related U.S. Application Data of application No. 14/640,449, filed on Mar. 6, 2015, now Pat. No. 9,742,139.

(60) Provisional application No. 61/954,081, filed on Mar. 17, 2014.

(51) Int. Cl.
*H01R 13/639* (2006.01)
*B25B 13/48* (2006.01)

(56) References Cited

U.S. PATENT DOCUMENTS

| | | | | |
|---|---|---|---|---|
| 7,080,985 | B2 * | 7/2006 | Hopper | H01R 13/625 174/86 |
| 10,063,025 | B2 * | 8/2018 | Small | B25B 23/0085 |
| 2017/0162989 | A1 * | 6/2017 | Hughes | H01R 13/56 |

* cited by examiner

METHOD OF MANUFACTURING CABLE CONNECTOR HAND TOOLS

CROSS-REFERENCE TO RELATED APPLICATION

This application is a divisional application of U.S. patent application Ser. No. 15/423,827, filed on Feb. 3, 2017, U.S. Pat. No. 10,305,241, entitled "METHOD OF MANUFACTURING A HAND TOOL FOR COUPLING TOGETHER FIRST AND SECOND CABLE SECTIONS," which claims priority to U.S. Pat. No. 9,742,139, issued Aug. 22, 2017, entitled "METHODS OF USING A HAND TOOL TO COUPLE TOGETHER FIRST AND SECOND CABLE SECTIONS", which claims priority to U.S. Provisional Patent Application Ser. No. 61/954,081, filed on Mar. 17, 2014, entitled "CABLE CONNECTOR HAND TOOLS", the disclosures of which are expressly incorporated herein by reference.

STATEMENT REGARDING FEDERALLY SPONSORED RESEARCH OR DEVELOPMENT

The invention described herein was made in the performance of official duties by an employee of the Department of the Navy and may be manufactured, used and licensed by and for the United States Government for any governmental purpose without payment of any royalties thereon. This invention (NC 200,558) is assigned to the United States Government and is available for licensing for commercial purposes. Licensing and technical inquires may be directed to the Technology Transfer Office, Naval Surface Warfare Center Crane, email: cran_cto@navy.mil.

BACKGROUND AND SUMMARY OF THE DISCLOSURE

The present invention relates to a hand tool for use with loosening and tightening cable connections. In particular, an illustrative embodiment hand tool is used for hand tightening or loosening cable connectors. When tightening the cable connectors, the illustrative hand tool compresses mating cable sections and/or creates a seal between mating cable sections. The hand tool is configured to prevent over torqueing the connection that may cause damage to such connectors. The hand tool is small, and is adapted to be used in confined spaces within which conventional wrenches or tools are unable to effectively operate. The hand tool can be used in harsh environments and with slick hands. The hand tool permits visual inspection of mating (i.e., position) of the connectors relative to each other, which indicates relative position of cable mating sections in order to ensure the cable connectors are fully seated. The hand tool is configured for use with cables where conventional tools cannot be effectively inserted or removed (e.g., a socket or wrench including a handle cannot effectively be used due to confined space and/or the need to apply force to two different sides of an installed connector assembly so as to couple two cable sections), and which prevents injuries to an operator when having to apply force to loosen the connectors after they have been in an installed configuration for a significant time period.

According to an illustrative embodiment of the present disclosure, a cable connection hand tool includes a first cable connector hand tool member and a second cable connector hand tool member. Each of the first and second cable connector hand tool members includes a body defining a side opening to allow a cable conduit portion to pass into a center opening, an inner wall of the body defining a first recessed portion formed with a plurality of keyways to cooperate with keys on a cable connector receiving the cable conduit portion, and a lip extending inwardly from the inner wall and spaced apart from the keyways to cooperate with a ring wall formed on the cable connector.

According to another illustrative embodiment of the present disclosure, a cable connection hand tool includes a pair of cable connector hand tool sections, each having a rectangular body defining a center aperture and flat edges around at least three sides of the body, and an aperture in a fourth side of the body defining a side opening that is operable to permit a cable to pass through the side opening into the center aperture of the body. The body is formed with a recessed section which is adapted to receive a proximal end of one of a pair of cable connectors such that mating edges of the cable connectors are visible when the cable connectors are in a connected configuration. The recessed portion is formed with a plurality of spaced apart recesses that are operable to engage protrusions on an outer wall of the cable connector. The cable connectors engage each other with respective male and female threaded connection sections, each of the cable connectors including a lip which extends from a distal end and surrounds the cable, and is adapted to engage with a corresponding wall formed on the cable. The cable connectors apply compressive force to the ends of a cable when the tool sections rotate the cable connectors via the threaded sections of the cable connectors.

According to a further illustrative embodiment of the present disclosure, modified connector hand tool sections each have an outer housing with a removable insert. The housing permits insertion of an insert into an insert recess in the housing which has a different recessed section that is sized for coupling with specific pairs of cable connectors which have different outer diameters, as well as optionally different placement of keys or protrusions. The inserts can be retained in the outer housing which has detents or other releasable coupling structures adapted to retain or couple with the insert, including spring loaded ball bearings that engage with a depression in the insert, or fasteners or thumbscrews which couple the housing with the insert.

According to another illustrative embodiment of the present disclosure, a method of using a hand tool to couple together first and second cable sections includes the steps of providing first and second cable sections including first and second cable connecting ferrules, the first and second cable connecting ferrules each having a radially outwardly extending sealing flange, providing first and second cable connectors, the first and second cable connectors each including a body having a connector passageway configured to receive and slide over the first and second cable sections, and a wall at the distal end of the body configured to engage with the sealing flange of one of the first and second cable connection sections, providing a cable connector hand tool including first and second hand tool members, coupling together the first and second cable sections, and threadably coupling together the first and second cable connectors. The method further includes the steps of coupling the first hand tool member with the first cable connector, coupling the second hand tool member with the second cable connector, and applying rotational force to the first and second hand tool members, thereby tightening together the first and second cable connectors. The method further includes the step of visually examining an interface of the first and second cable connectors between the first and second hand tool members to verify that mating surfaces of the first and second cable connectors are in physical contact, such that the sealing flanges of the first and second connecting ferrules are fully seated in sealing engagement.

According to a further illustrative embodiment of the present disclosure, a method of manufacturing a hand tool for coupling together first and second cable sections includes the steps of providing a first cable connector hand tool member including a first rectangular body formed with at least three flat edges, the first rectangular body having a width and a height configured to facilitate gripping by a user, and forming a center passageway within the first rectangular body and extending between opposing inner and outer surfaces, the center passageway having a diameter configured to receive a first cable connector nut. The method further includes the steps of forming a side opening within a side edge of the first rectangular body and extending into the center passageway, the side opening dimensioned to receive a first cable conduit, and forming a recessed portion within the first rectangular body concentric to the center passageway and having a diameter configured to define an arcuate lip for engaging a distal wall of the first cable connector nut, the recessed portion having a depth such that an axial mating surface of the first cable connector nut is configured to extend beyond the inner surface of the first rectangular body. The method also includes the step of forming circumferentially spaced, radially extending keyways within the recessed portion to accommodate keys supported on the first cable connector nut. The method further includes the steps of providing a second cable connector hand tool member including a second rectangular body formed with at least three flat edges, the second rectangular body having a width and a height configured to facilitate gripping by a user, and forming a center passageway within the second rectangular body and extending between opposing inner and outer surfaces, the center passageway having a diameter configured to receive a second cable connector nut. The method further includes the steps of forming a side opening within a side edge of the second rectangular body and extending into the center passageway, the side opening dimensioned to receive a second cable conduit, and forming a recessed portion within the second rectangular body concentric to the center passageway and having a diameter configured to define an arcuate lip for engaging a distal wall of the second cable connector nut, the recessed portion having a depth such that an axial mating surface of the second cable connector nut is configured to extend beyond the inner surface of the second rectangular body. The method also includes the step of forming circumferentially spaced, radially extending keyways within the recessed portion to accommodate keys supported on the second cable connector nut.

According to another illustrative embodiment of the present disclosure, a method of manufacturing a hand tool for coupling together first and second cable sections includes determining a clearance measurement in a confined space receiving a cable connector assembly adapted to couple together mating cable sections including a plug and a socket, wherein the cable connector assembly includes first and second cable connecting nuts, each of the cable connecting nuts formed with keys extending radially outwardly from an outer surface, and including a threaded connecting portion, the threaded connecting portions of the first and second cable connecting nuts threadably engaging each other to couple the plug and the socket of the mating cable sections by compressive force applied to the mating cable sections. The first and second cable connecting nuts are adapted to abut each other at mating surfaces when fully threadably engaged with each other. The cable connector assembly is located in the confined space such that the space does not permit use of a wrench with a handle for 360 degree rotation of the first and second cable connecting nuts. The method further includes determining, based on the clearance measurement, a maximum outer dimensional envelope for first and second hand tool members adapted to engage with the keys on the first and second cable connecting nuts and permit visibility of the mating surfaces of the first and second cable connecting nuts between the first and second hand tool members. Illustratively, the method further includes determining a predetermined amount of torque on the first and second hand tool members required to rotatably couple the first and second cable connecting nuts so as to fully engage the plug and the socket of the mating cable sections, and then determining a minimum dimensional envelope of the first and second hand tool members based on the predetermined torque and a predetermined injury force associated with a shape of the first and second hand tool members based on a force that causes an abrasive or force application injury to an operator's hand using the hand tool a first plurality of times.

Additional features and advantages of the present invention will become apparent to those skilled in the art upon consideration of the following detailed description of the illustrative embodiment exemplifying the best mode of carrying out the invention as present perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
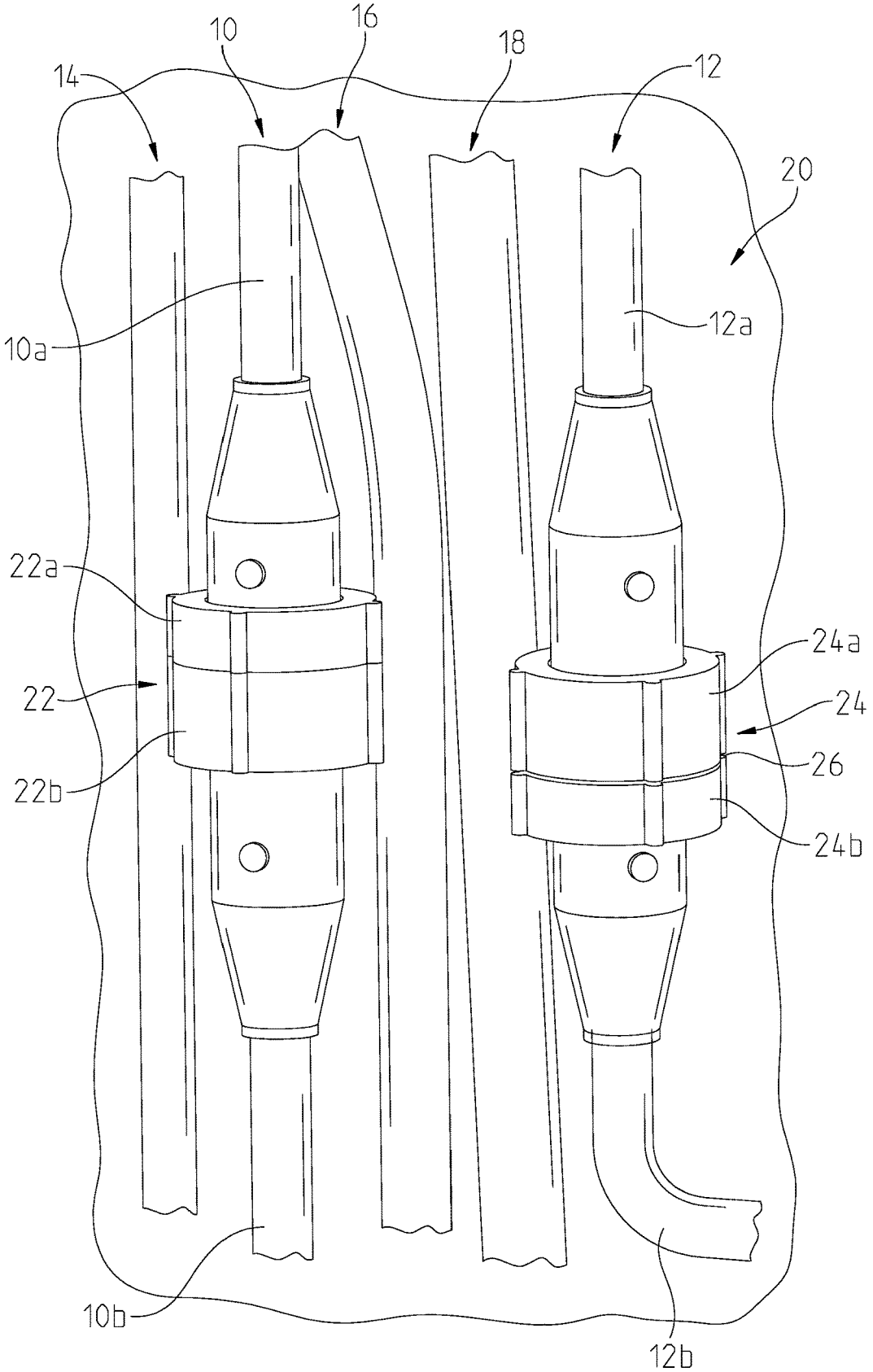
FIG. 1 is a perspective view of illustrative cable sections and cable connectors in a connected configuration and positioned within a confined space, the cable sections and the cable connectors of the type for use with an illustrative hand tool of the present disclosure.

Referring initially to FIG. 1, illustrative cables 10, 12, 14, 16, 18 are shown supported within a confined space or chamber 20. Cables 10 and 12 are shown to include mating cable sections 10*a*, 10*b* and 12*a*, 12*b*, respectively. The mating cable sections 10*a*, 10*b* and 12*a*, 12*b* are illustratively coupled together through cable connector assemblies 22 and 24 defined by cable connectors 22*a*, 22*b* and 24*a*, 24*b*, respectively. In this view, the cable sections 10*a*, 10*b* and 12*a*, 12*b* and the cable connectors 22*a*, 22*b* and 24*a*, 24*b* are shown in connected configurations. First cable connectors 22*a*, 22*b* are illustratively shown in physical contact with each other (i.e., fully threaded together such that no or minimal gap exists therebetween), thereby defining a fully seated or sealing engagement between the cable sections 10*a*, 10*b*. Second cable connectors 24*a*, 24*b* are illustratively shown coupled together such that a gap 26 exists therebetween, defining a less than fully seated or sealing engagement between the cable sections 12*a*, 12*b* which, over time, may result in water leakage and/or failure of the connection between cable sections 12*a* and 12*b*. The illustrative cable connection hand tool 100 further detailed herein is configured to facilitate a fully seated of connected configuration between the cable sections 10*a* and 10*b*, while being adapted for use within the confined space 20 which does not permit use of a conventional tool, such as a wrench with a handle, for 360 degree rotation.

The confined space or chamber 20 may illustratively be defined by any conventional storage unit, cabinet, locker or control box. In one illustrative embodiment, the confined chamber 20 is defined by a sonar dome supported by a hull of a ship. In such an illustrative embodiment, the first cable sections 10*a* and 12*a* may be electrically coupled to an external controller, while the second cable sections 10*b* and 12*b* may be electrically coupled to sonar transducers. Such a sonar dome may be difficult to access and experience harsh environmental conditions, including moisture exposure to the cables received therein.

Figure 2:
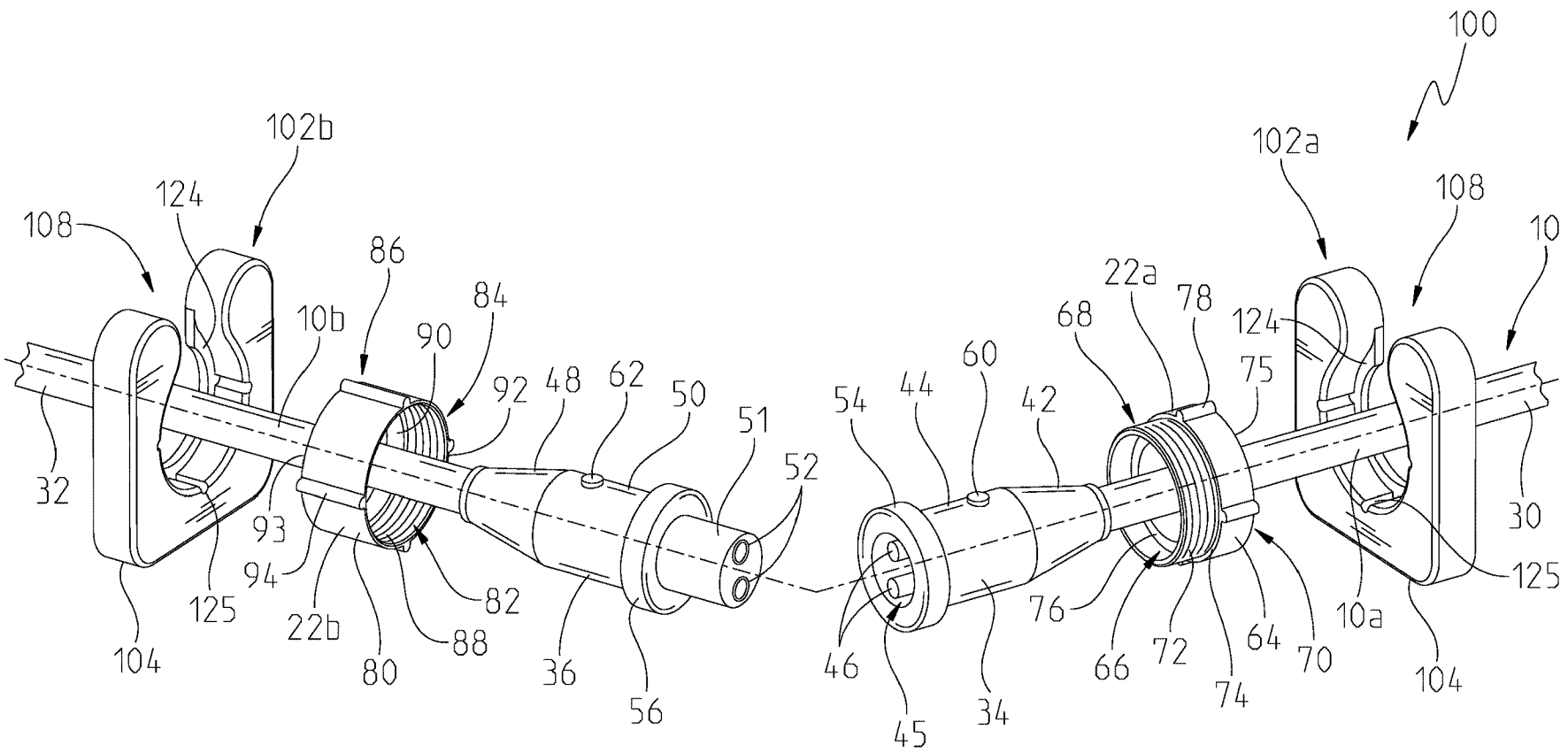
FIG. 2 is a perspective view of illustrative cable sections and cable connectors in a disconnected configuration, the cable sections and the cable connectors of the type shown in FIG. 1 for use with the illustrative hand tool of the present disclosure.
Figure 7:
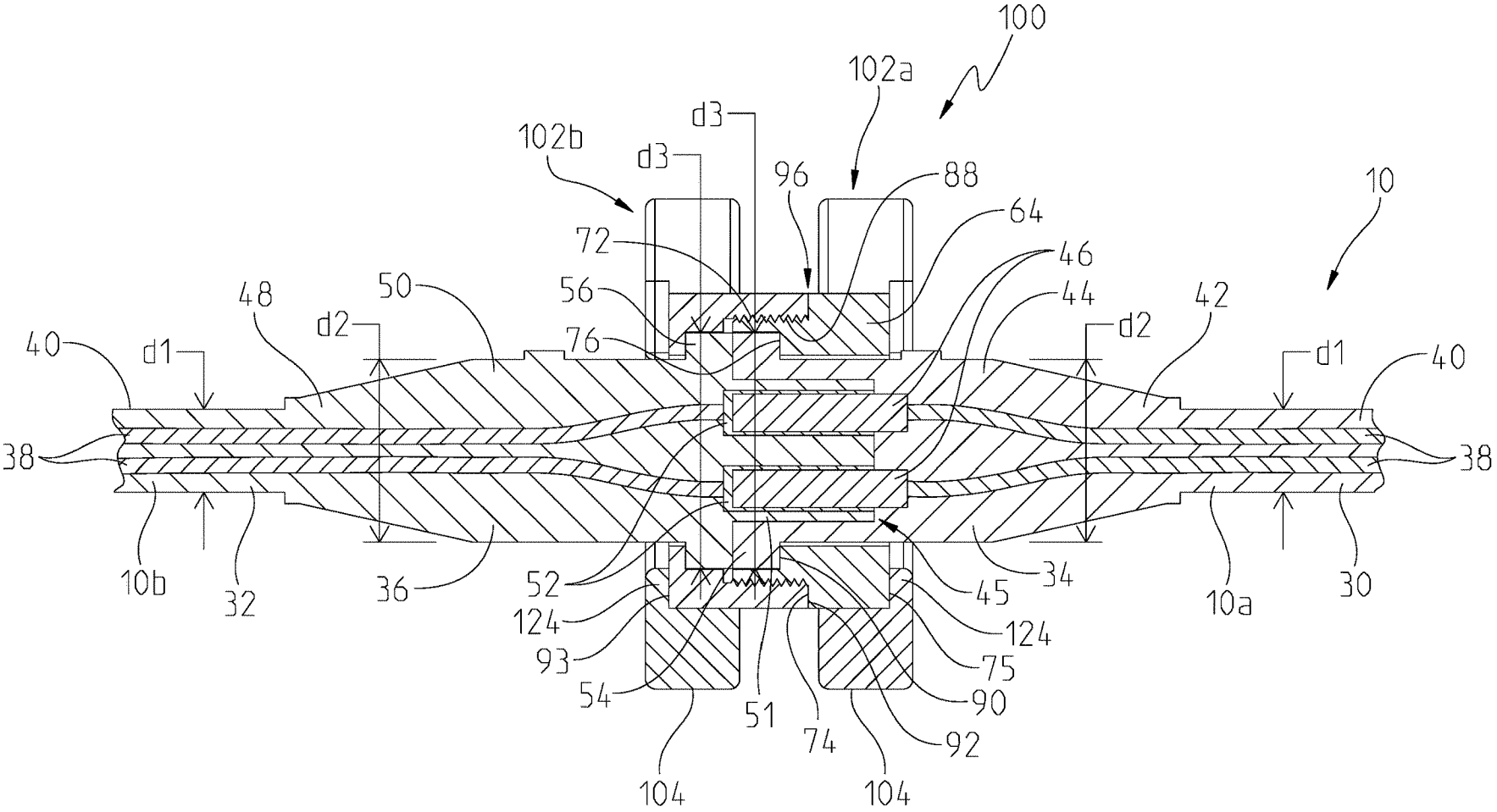
FIG. 7 is a cross-sectional view taken along line 7-7 of FIG. 6.
Figure 8:
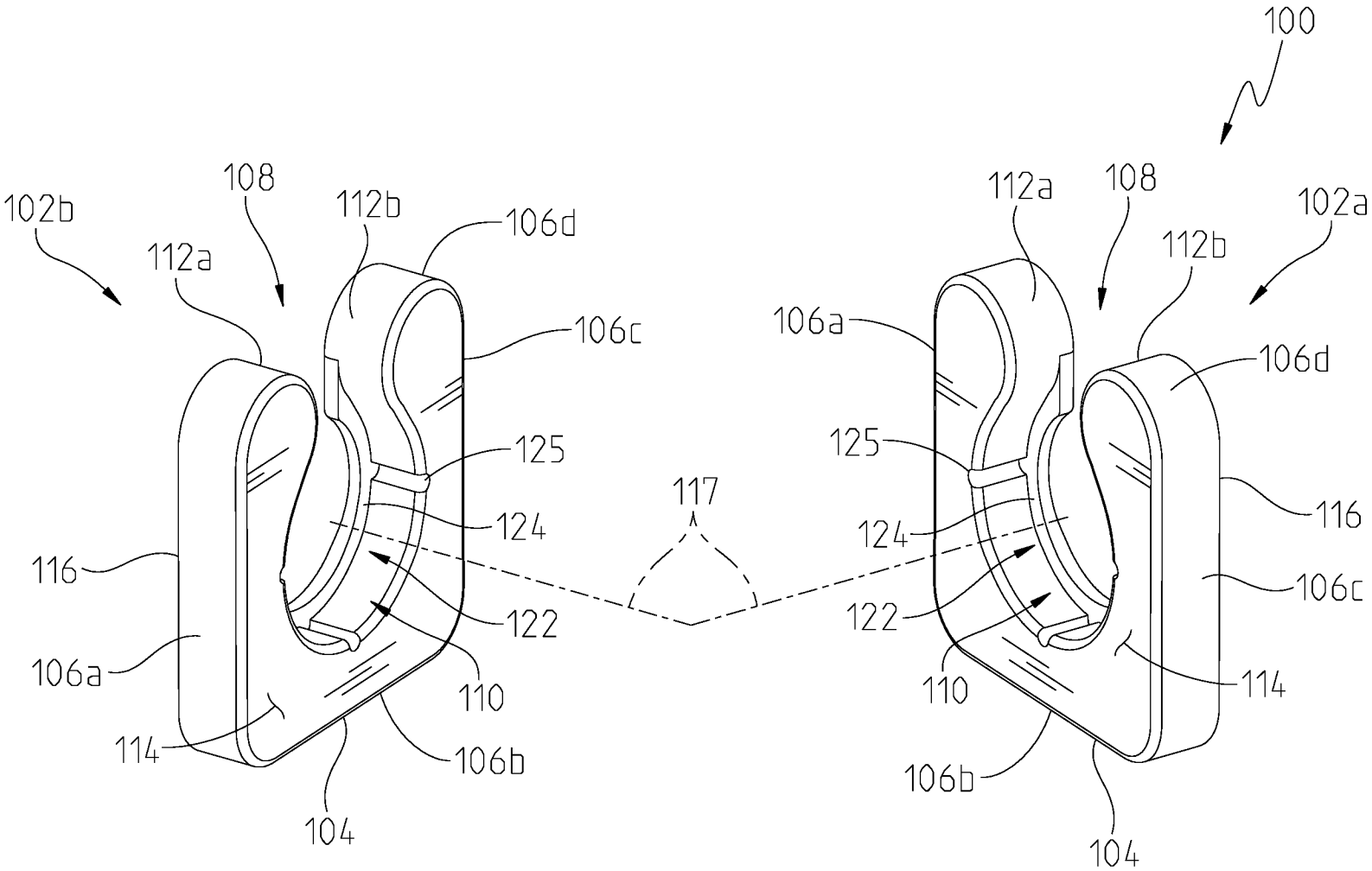
FIG. 8 is a perspective view of opposing hand tool members of the illustrative hand tool.
Figure 9:
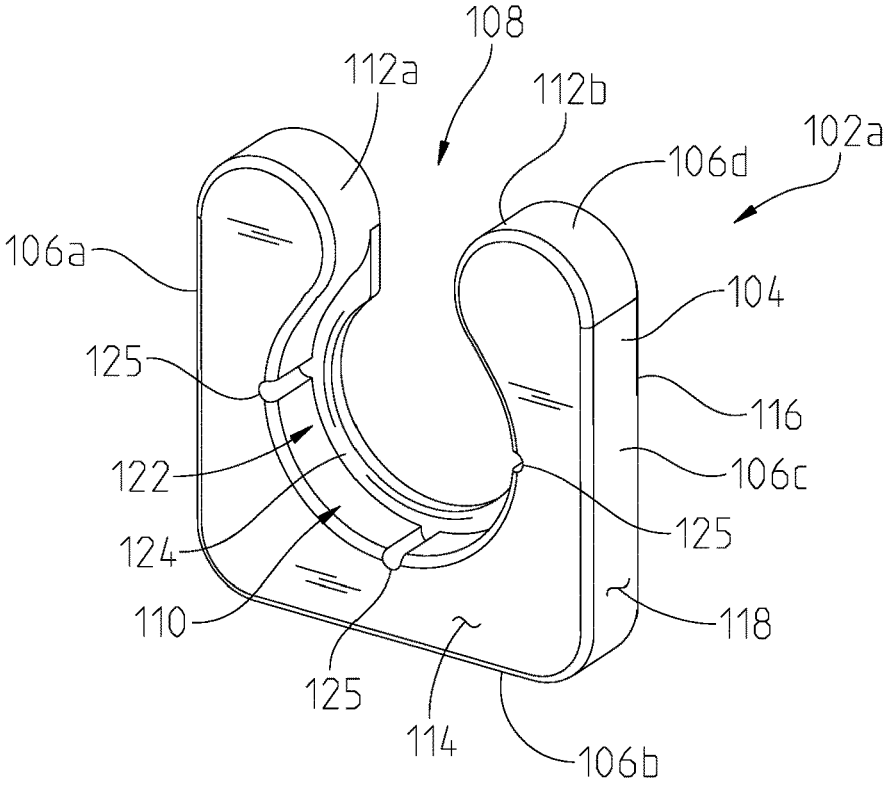
FIG. 9 is a front perspective view of an illustrative hand tool member of the present disclosure.
Figure 10:
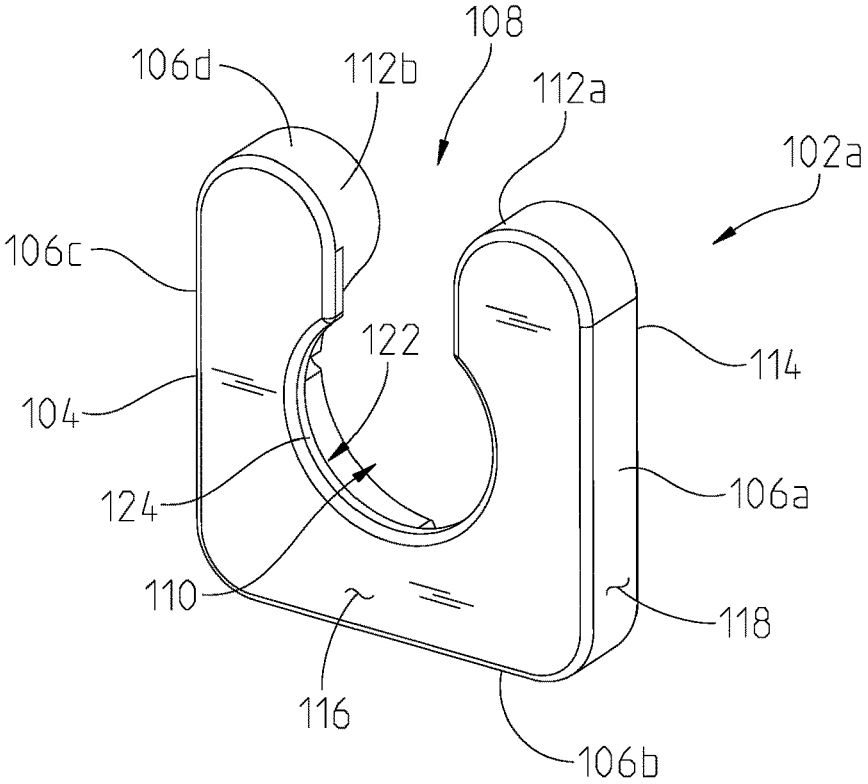
FIG. 10 is a rear perspective view of an illustrative hand tool member of the present disclosure.

FIG. 2 is a perspective view showing illustrative cable sections 10*a*, 10*b* and cable connectors 22*a*, 22*b* in a disconnected configuration. While the following description refers to cable 10 and associated components, it is noted that cable 12 has a substantially similar structure. Illustratively, the cable sections 10*a*, 10*b* include conduit portions 30, 32 and enlarged connecting portions or ferrules 34, 36, respectively. The conduit portions 30, 32 each illustratively include electrical wires 38 and an outer sheath 40 (FIG. 7). The wires 38 are illustratively formed of a conductive material, such as copper. The outer sheath 40 is illustratively formed of an electrically insulating material, such as an elastomer.

First or female enlarged connecting portion or ferrule 34 includes a distal tapered section 42 and a cylindrical section 44 defining a proximal socket or receptacle 45. The tapered section 42 transitions from a first outer diameter d1 of the conduit portion 30 to a second outer diameter d2 of the cylindrical section 44, where the second outer diameter d2 is greater than the first outer diameter d1 (FIG. 7). Female connecting portion 34 includes a pair of electrically conductive pins 46 within socket 45. Pins 46 are illustratively formed of an electrically conductive material, such as copper, and are electrically coupled to wires 38.

Second or male enlarged connecting portion or ferrule 36 includes a distal tapered section 48 and a proximal cylindrical section 50 including a protrusion or plug 51. The tapered section 48 transitions from a first outer diameter d1 of the conduit portion 32 to a second outer diameter d2 of the cylindrical section 50, where the second outer diameter d2 is greater than the first outer diameter d1 (FIG. 7). The protrusion 51 illustratively includes a pair of electrically conductive sockets 52. Sockets 52 are illustratively formed of an electrically conductive material, such as copper, and are electrically coupled to wires 38. The protrusion 51 of male connecting portion 36 is received within the socket 45 of female connecting portion 34, wherein the pair of pins 46 electrically couple with the sockets 52.

Female connecting portion or ferrule 34 illustratively includes a radially outwardly extending sealing ring wall or flange 54 positioned at the proximal end of the socket 45. The flange 54 includes an outer diameter d3 greater than the outer diameter d2 of cylindrical section 50 (FIG. 7). Male connecting portion or ferrule 36 includes a radially outwardly extending sealing wall or flange 56 positioned at a distal end of the protrusion 51. The flange 56 includes an outer diameter d3 greater than the outer diameter d2 of the cylindrical section 50 (FIG. 7). Alignment tabs 60 and 62 are supported by the cylindrical sections 44 and 50 to facilitate proper rotational orientation of the female connecting portion 34 and the male connecting portion 36.

First cable connector 22*a* illustratively comprises a connecting nut including a cylindrical body 64 defining a central passageway 66 extending between proximal and distal ends 68 and 70. A threaded connecting portion includes a plurality of external or male threads 72 supported by an outer surface of the body 64 at the proximal end 68. An axially inwardly facing mating surface 74 is supported by the body 64 distally of the external threads 72. An axially outwardly facing distal wall or contact surface 75 is defined by the distal end 70 of body 64. An inner wall or retaining lip 76 extends radially inwardly at the distal end 70 of the body 64. A plurality of circumferentially spaced protrusions 78, illustratively keys, lugs or ribs, extend radially outwardly from the outer surface of the cylindrical body 64 proximate the distal end 70. Illustratively, the first cable connector 22*a* is formed from a molded polymer.

Second cable connector 22*b* illustratively comprise a connecting nut including a cylindrical body 80 defining a central passageway 82 extending between proximal and distal ends 84 and 86. A threaded connecting portion includes a plurality of internal or female threads 88 supported by an inner surface of the body 80 at the proximal end 84. An inner retaining lip 90 extends radially inwardly at the distal end 86 of the body 80. An axially inwardly facing mating surface 92 is supported by the body 80 at the proximal end 84. An axially outwardly facing distal wall or contact surface 93 is defined by the distal end 86 of the body 80. A plurality of circumferentially spaced protrusions 94, illustratively keys, lugs or ribs, extend radially outwardly from the outer surface of the cylindrical body 80 proximate the distal end 86. Illustratively, the second cable connector 22*b* is formed from a molded polymer.

In a coupled configuration, the external threads 72 of the first cable connector 22*a* are threadably coupled to the internal threads 88 of the second cable connector 22*b*. As the first cable connector 22*a* is tightened relative to the second cable connector 22*b*, the retaining lips 76 and 90 move axially towards each other, thereby applying a compressive force between the flanges 54 and 56 of the connecting portions 34 and 36 of cable sections 10*a* and 10*b*, respectively. The axially facing mating surfaces 74 and 92 define a mating interface 96 visible to a user between hand tool members 102*a* and 102*b* when the first cable connector 22*a* is fully threadably engaged with the second cable connector 22*b*, such that the cable sections 10*a* and 10*b* are fully seated with each other. In the fully seated configuration, the seal between flanges 54 and 56 prevents water and/or debris from interfering with the electrical connection between the sockets 52 and pins 46.

With further reference to FIGS. 2-8, illustrative cable connection hand tool 100 of the present disclosure is shown including a first hand tool section or member 102*a* and a second hand tool section or member 102*b*. The first hand tool member 102*a* is substantially identical to the second hand tool member 102*b*. The first hand tool member 102*a* is configured to couple with the first cable connector 22*a*, and the second hand tool member 102*b* is configured to couple with the second cable connector 22*b*.

Figure 11:
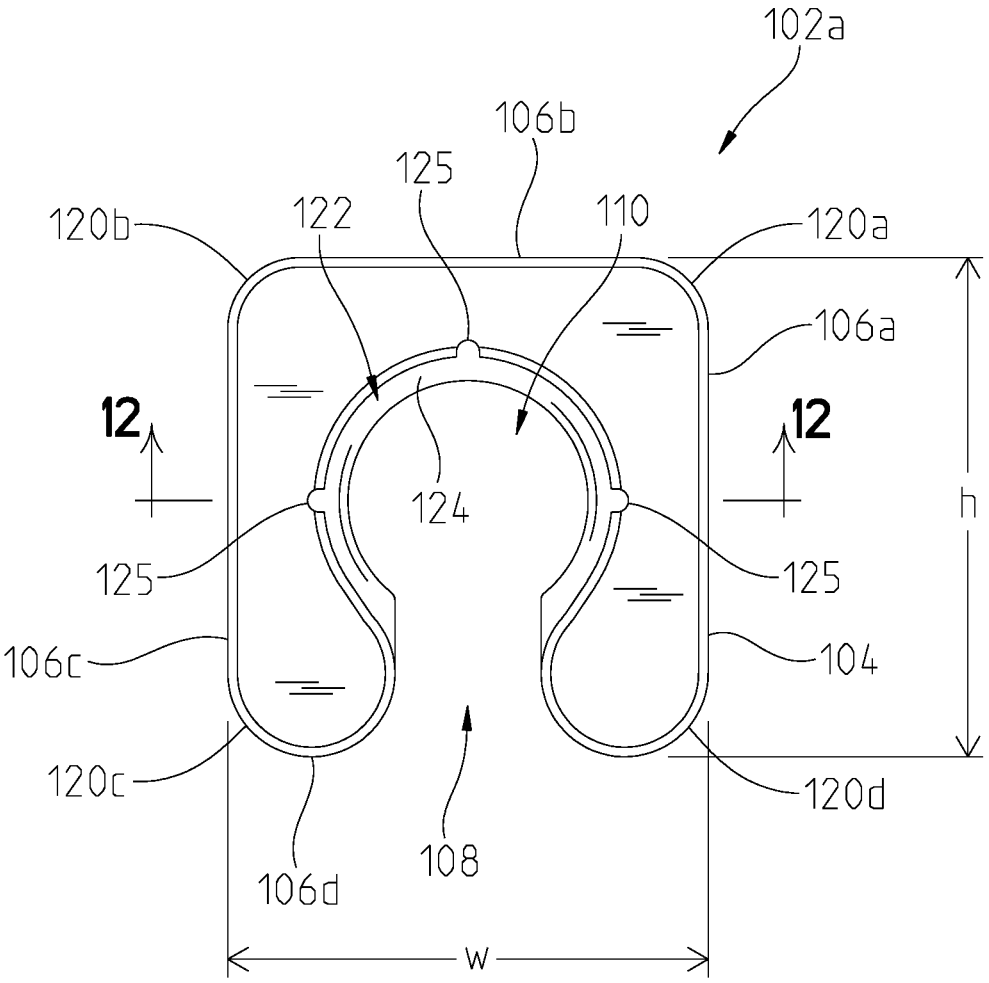
FIG. 11 is a rear plan view of the illustrative hand tool member of FIG. 9.

According to the illustrative embodiment of FIGS. 8-12, first and second hand tool members 102*a* and 102*b* each include a rectangular body 104 formed with flat edges or sections 106*a*, 106*b*, 106*c*, 106*d* around at least three sides. As further detailed herein, the size and shape of the body 104 may be based on a variety of factors, including: confined space 20 constraints, torque application specifications, and/or operator ergonomics. For example, the width (w) and height (h) of body 104 (FIG. 11) define a dimensional envelope within a range between a maximum (illustratively based on a clearance measurement within the confined space 20) and a minimum (illustratively based on a predetermined torque required to tighten the cable connectors 22*a* and 22*b*, and/or a predetermined injury force). The clearance measurement is based on the area required to rotate 360 degrees the hand tool 100 within the confined space 20 for tightening the cable connectors 22*a* and 22*b*. The predetermined force is illustratively based on average force that would typically be applied by a user to hand tool 100 that would not cause repetitive use injury. To facilitate proper gripping of the tool members 102*a*, 102*b* and rotation within the confined space 20 with the predetermined torque, each body 104 is illustratively defined to have a width (w) of 2.5 inches and a height (h) of 2.5 inches (FIG. 11).

Each of the tool members 102*a* and 102*b* includes a first aperture or side opening 108 on one side 106*d* that is operable to permit cable section 10*a*, 10*b* to pass therethrough and into a center aperture or passageway 110. Opposing edges 112*a*, 112*b* of the side opening 108 are rounded to prevent damage to the cable 10 passing therethrough. The width of the side opening 108 is illustratively 0.5 inches. The center passageway 110 extends between opposing inner (proximal) and outer (distal) surfaces 114 and 116 of the body 104 along a longitudinal center axis 117. The center passageway 110 illustratively has a diameter of 1.25 inches. The body 104 is illustratively formed from a rigid durable material, such as aluminum for its light weight and durability.

The flat edges 106*a*, 106*b*, 106*c* of body 104 facilitate an operator gripping and rotating the tool member 102*a*, 102*b*, particularly in hot and wet environments. Outer surfaces 118 of the edges 106*a*, 106*b*, 106*c* may be textured to facilitate gripping. In certain illustrative embodiments, an elastomeric gripping surface may be applied to the outer surfaces 118 of the outer edges 106*a*, 106*b*, 106*c*. The corners 120*a*, 120*b*, 120*c*, 120*d* between the edges 106*a*, 106*b*, 106*c*, 106*d* are illustratively rounded to prevent damage to the cable 10 and potential injury to the hands of the operator (FIG. 11).

Figure 12:
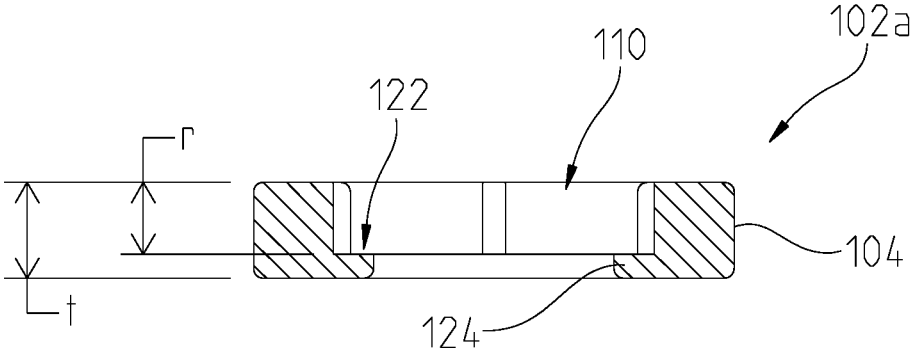
FIG. 12 is a cross-sectional view taken along line 12-12 of FIG. 11.

Each of the hand tool members 102*a*, 102*b* is formed with a recessed portion 122 formed concentrically to the center passageway 110 and defined by a retaining wall or lip 124. The recessed portion 122 is adapted to receive distal end one of the cable connectors 22*a*, 22*b* such that mating surfaces 74 and 92 at interface 96 of the cable connectors 22*a*, 22*b* are visible when the cable connectors 22*a*, 22*b* are in a coupled configuration. Illustratively, the recessed portion 122 has a diameter based on the outer diameter of the cooperating cable connector 22*a*, 22*b*. In the illustrative embodiment, the recessed portion has a diameter of 1.5 inches (FIG. 11), and a recess depth (r) from the inner surface 114 of 0.38 inches (FIG. 12). The recessed portion 122 is formed with a plurality of coupling members, illustratively second recesses or keyways 125, which are operable to engage cooperating coupling members, illustratively protrusions or keys 78, 94 on outer surface of body 64, 80 of the cable connector 22*a*, 22*b*. Illustratively, the keyways 125 are circumferentially spaced and extend radially outwardly. While three (3) keyways are shown, the number and placement may vary based upon the keys 78, 94 provided on the cable connectors 22*a*, 22*b*.

The cable end connectors 22*a*, 22*b* engage with each other with respective male and female threads 72 and 88. The cable connectors 22*a*, 22*b* are configured to provide axial compressive or coupling force to opposing ends of the cable 10 when the tool members 102*a* and 102*b* rotate the connectors 22*a* and 22*b* via the threads 72 and 88. Each of the connectors 22*a* and 22*b* illustratively includes flange or wall 76, 90 which extends from the body 64, 80 of the connector 22*a* and 22*b* from distal end 70, 86 and surrounds the cable 10 that is adapted to engage with the corresponding ring wall 54, 56 formed on an end of the cable 10.

Figure 3:
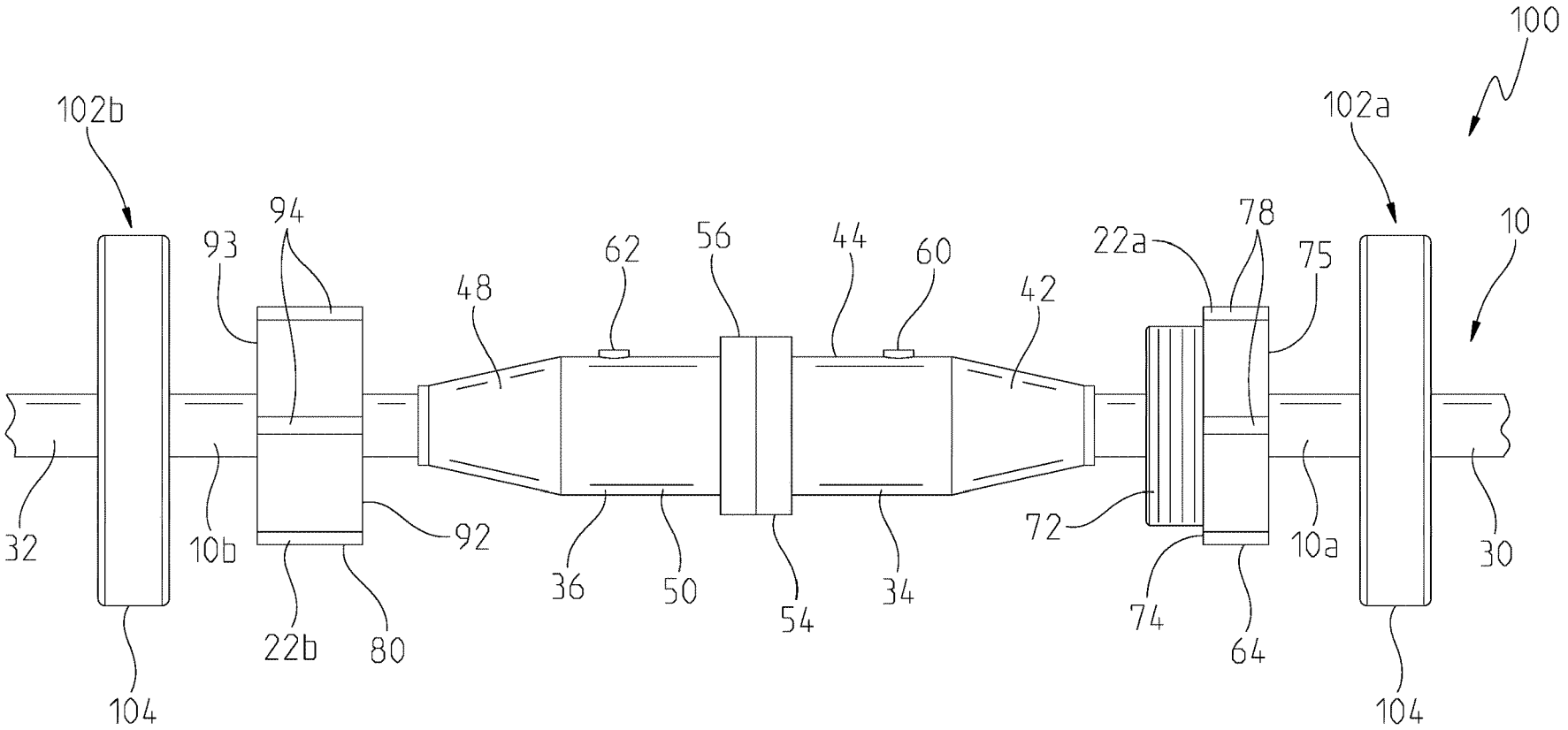
FIG. 3 is a side elevational view of the illustrative cable sections and cable connectors of FIG. 1 in a partially connected configuration, with the cable sections coupled together and the cable connectors uncoupled from each other.
Figure 4:
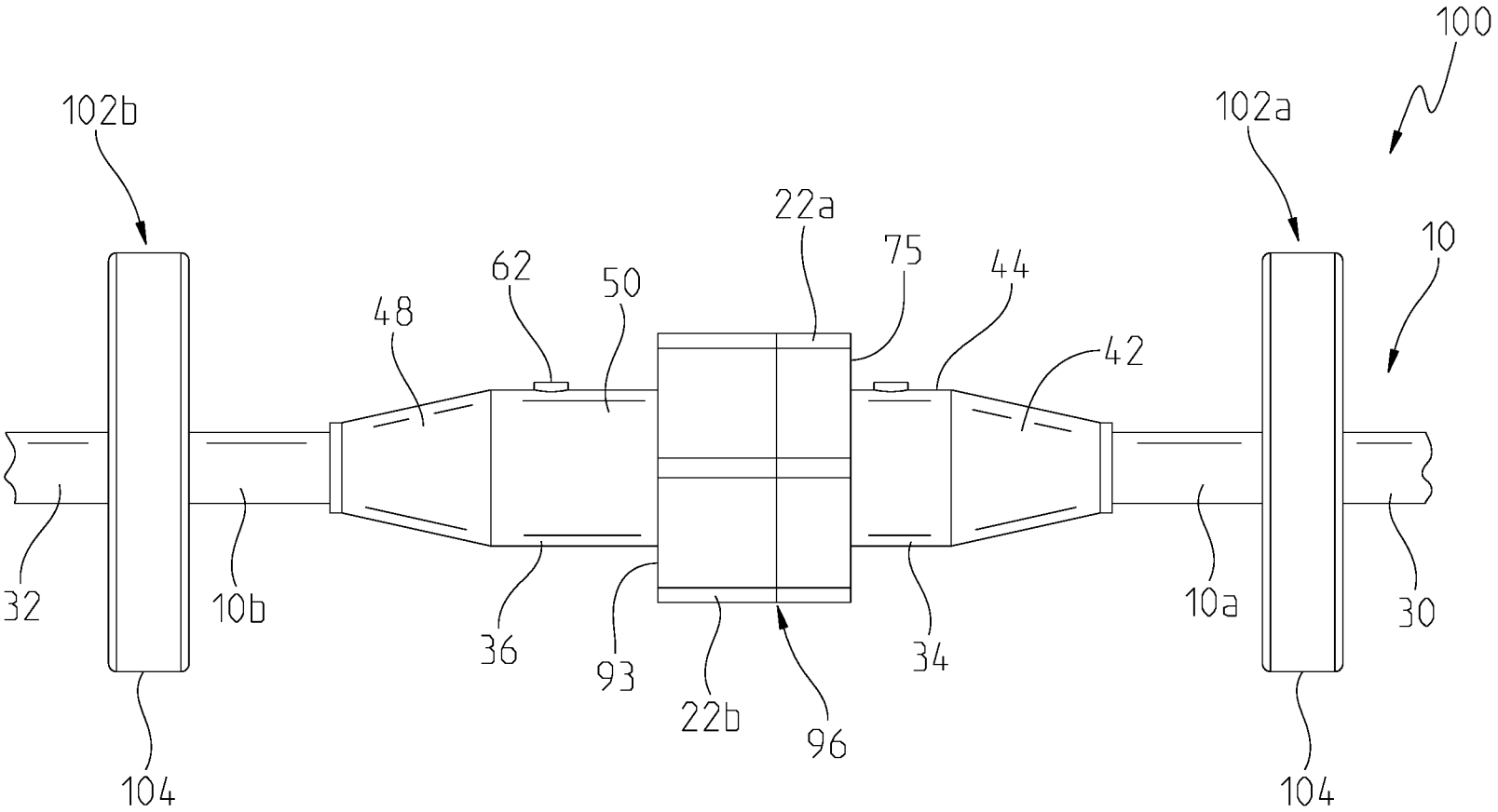
FIG. 4 is a side elevational view of the illustrative cable sections and cable connectors of FIG. 1 in a fully connected configuration, with the cable sections coupled together and the connectors coupled together.

FIG. 3 illustrates is a side elevational view of the cable sections 10*a* and 10*b* and cable connectors 22*a* and 22*b* in a partially connected configuration. More particularly, the cable connectors 22*a* and 22*b* are uncoupled but the cable sections 10*a* and 10*b* are coupled (i.e., protrusion 51 of male connecting portion 36 is received within socket 45 of female connecting portion 34). FIG. 4 shows the cable sections 10*a* and 10*b* coupled together, and the cable connectors 22*a* and 22*b* coupled together (threads 72 of first cable connector 22*a* threadably coupled with threads 88 of second cable connector 22*b*).

Figure 5:
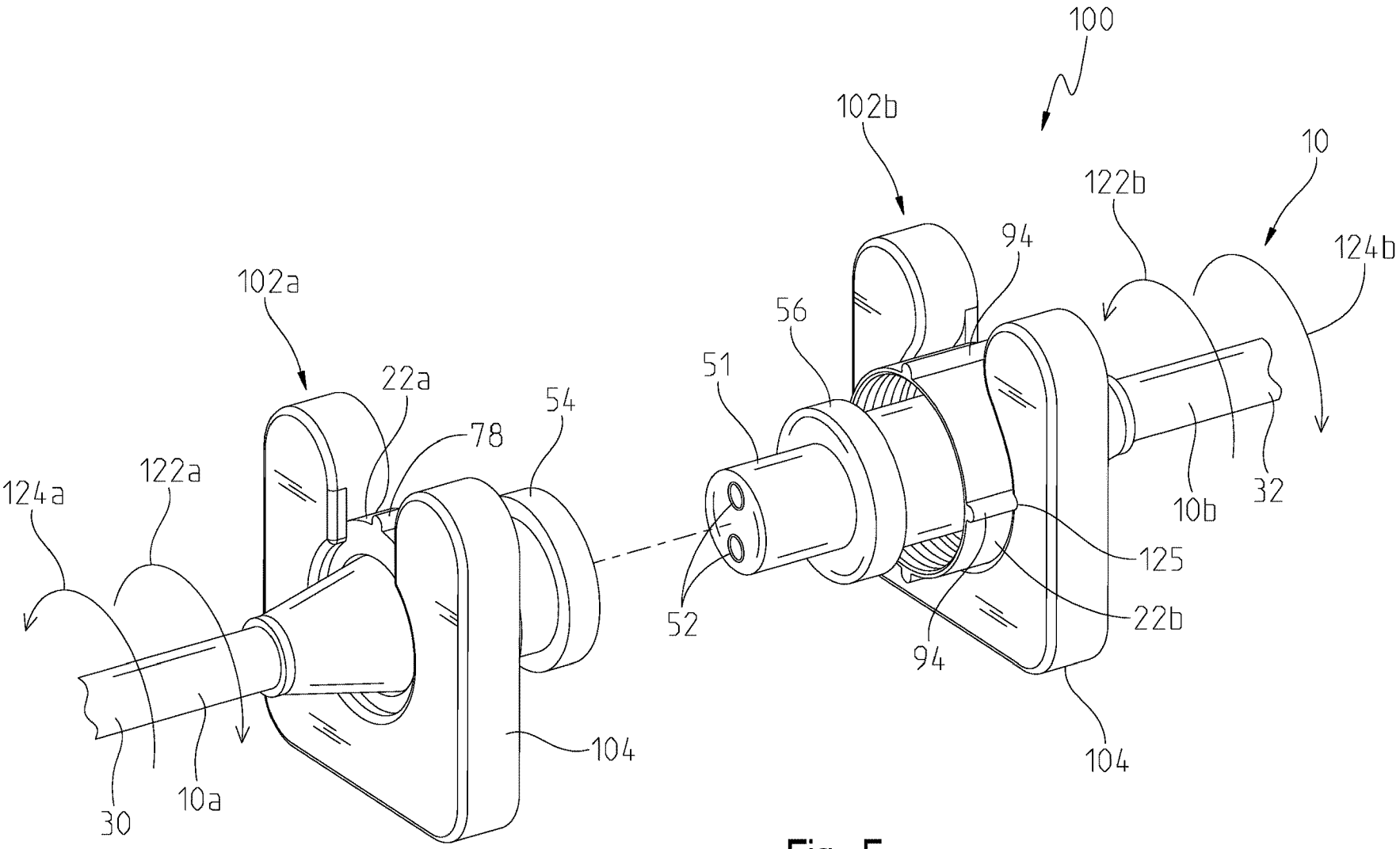
FIG. 5 is a perspective view of the illustrative cable sections and the cable connectors of FIG. 1 in a disconnected configuration, with illustrative cable connector hand tool members holding keyed cable connectors and formed with a radially inwardly extending lip for applying a compressive force against a fully connected configuration.
Figure 6:
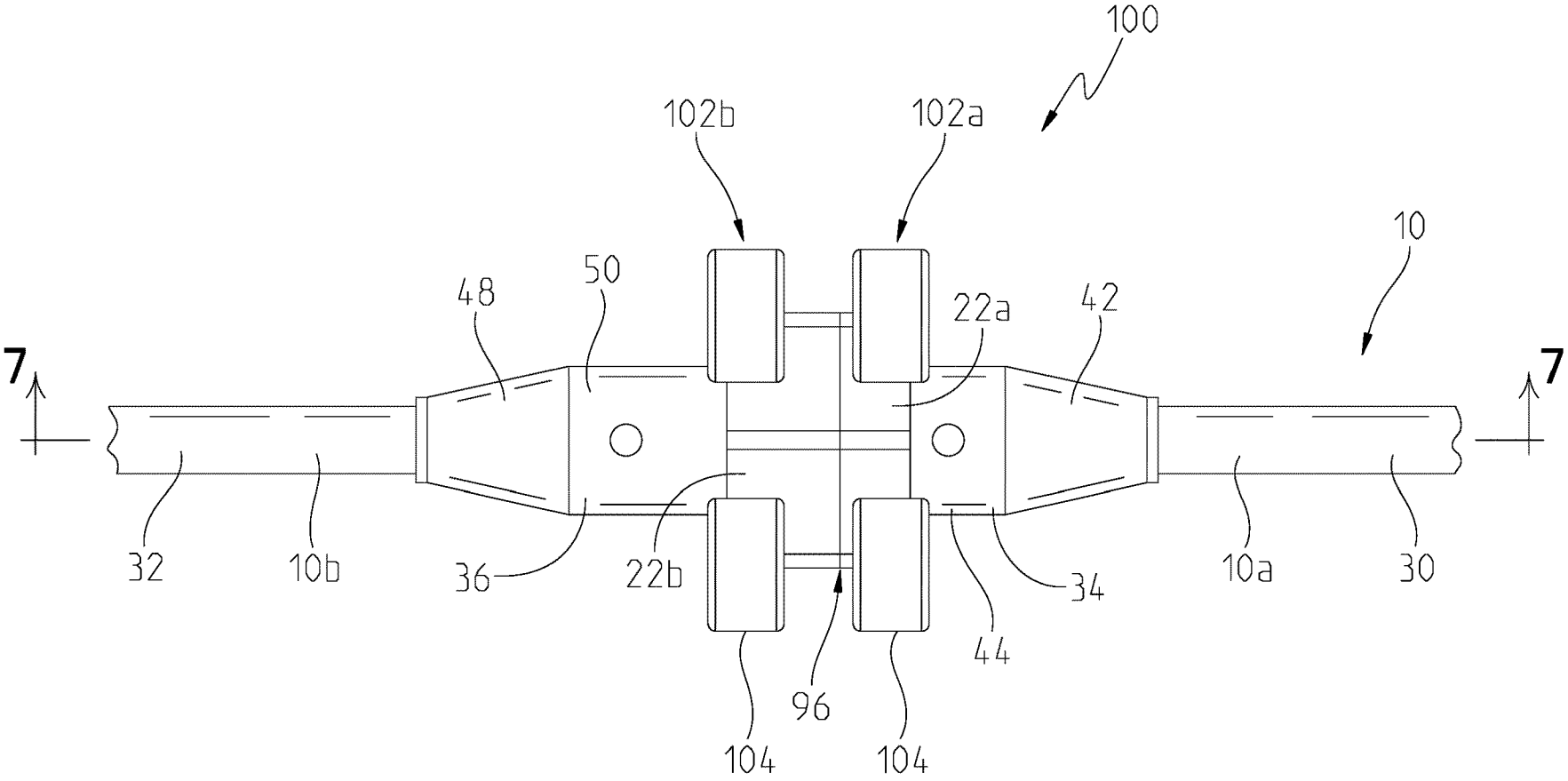
FIG. 6 is a side elevational view of the illustrative cable sections and cable connectors in a fully connected configuration, with the illustrative hand tool members configured to apply rotational force to either tighten or loosen the keyed cable connectors, such that a visual inspection of the mating relationship between the cable connectors is enabled.

FIGS. 5-7 illustrate applying rotational force to the hand tool members 102*a* and 102*b* to axially move the cable sections 10*a* and 10*b* into a sealing relationship as indicated by the mating surfaces 74 and 92 of the interface 96 of cable connectors 22*a* and 22*b*. More particularly, recessed portions of hand tool members 102*a* and 102*b* receive cable connectors 22*a* and 22*b*, such that contact surfaces 75 and 93 engage lips 124, and keys 78, 94 are received within keyways 125. With reference to FIG. 5, clockwise rotation of hand tool members 102*a* and 102*b* (in the direction of arrows 122*a* and 122*b*) tighten the connectors 22*a* and 22*b*, while counterclockwise rotation of the hand tool members 102*a* and 102*b* (in the direction of arrows 124*a* and 124*b*) loosen the connectors 22*a* and 22*b*.

Figure 13:
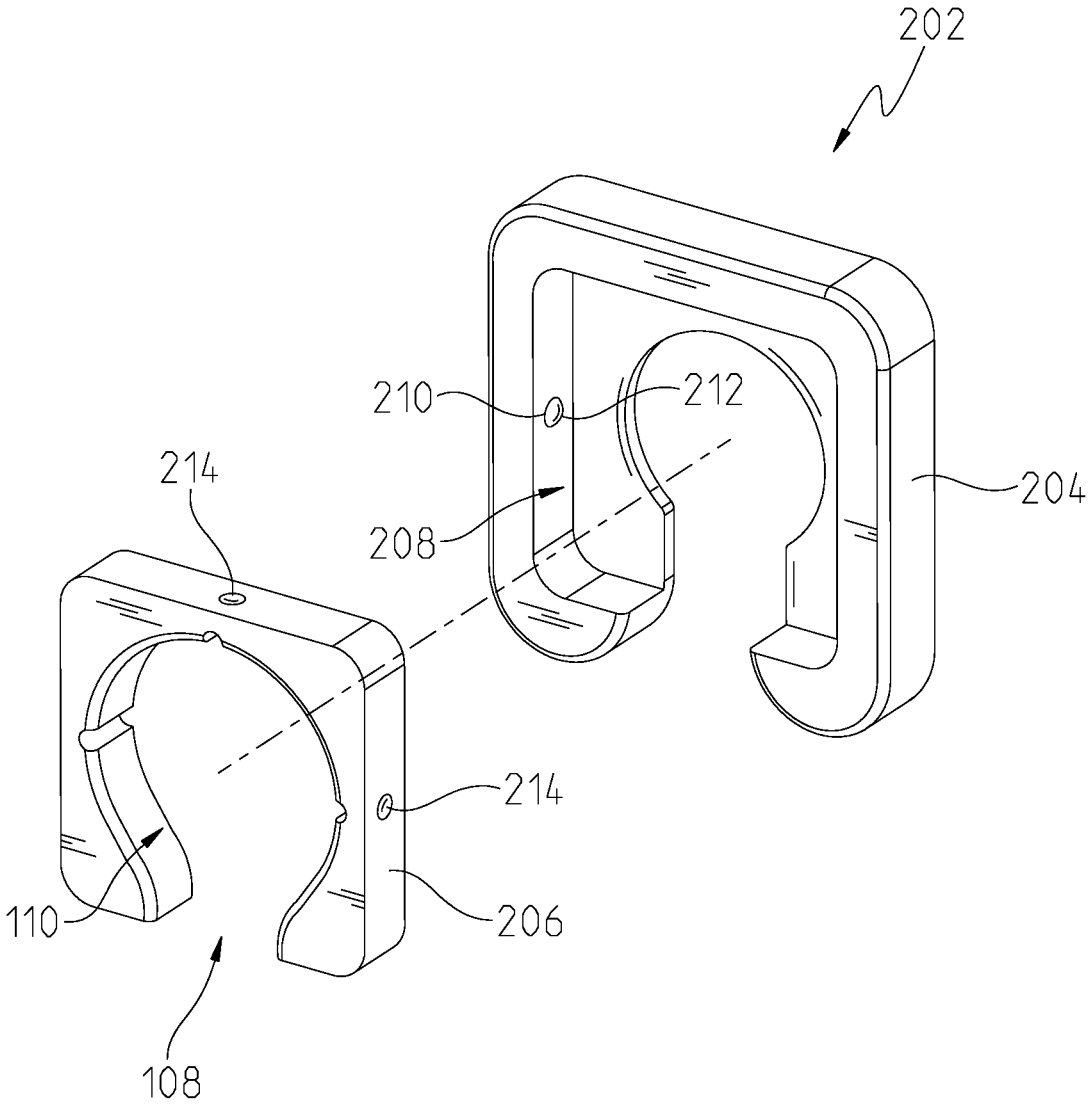
FIG. 13 is a exploded perspective view of a further illustrative hand tool member of the present disclosure including an insert within an outer frame thereby providing an ability to manipulate different shaped cable connectors.

FIG. 13 shows a further illustrative embodiment hand tool member 202 including an outer frame or housing 204 receiving a die or insert 206. Hand tool member 202 includes many similar elements as hand tool members 102*a* and 102*b*. As such, similar components will be identified with like reference numbers.

Substitution of different inserts 206 within the outer frame 204 provides for the ability to manipulate cable connectors 22*a*, 22*b* having different shapes and/or sizes. More particularly, the outer frame 204 includes a recess 208 configured to receive different inserts 206 having different sized center passageways and/or recessed portions configured to couple with specific pairs of cable connectors 22*a*, 22*b* which have different shapes and outer diameters, as well as optionally different placement of keys, protrusions or lugs 78, 94. A plurality of retainers 210 maintain the insert 206 within the outer frame 204. Retainer 210 may include spring loaded ball bearings 212 that engage within a depression or opening 214 in the insert 206. Alternatively, the retainer 210 may comprise other conventional coupling means, such as fasteners or thumb screws which couple the outer frame 204 with the insert 206.

Figure 14:
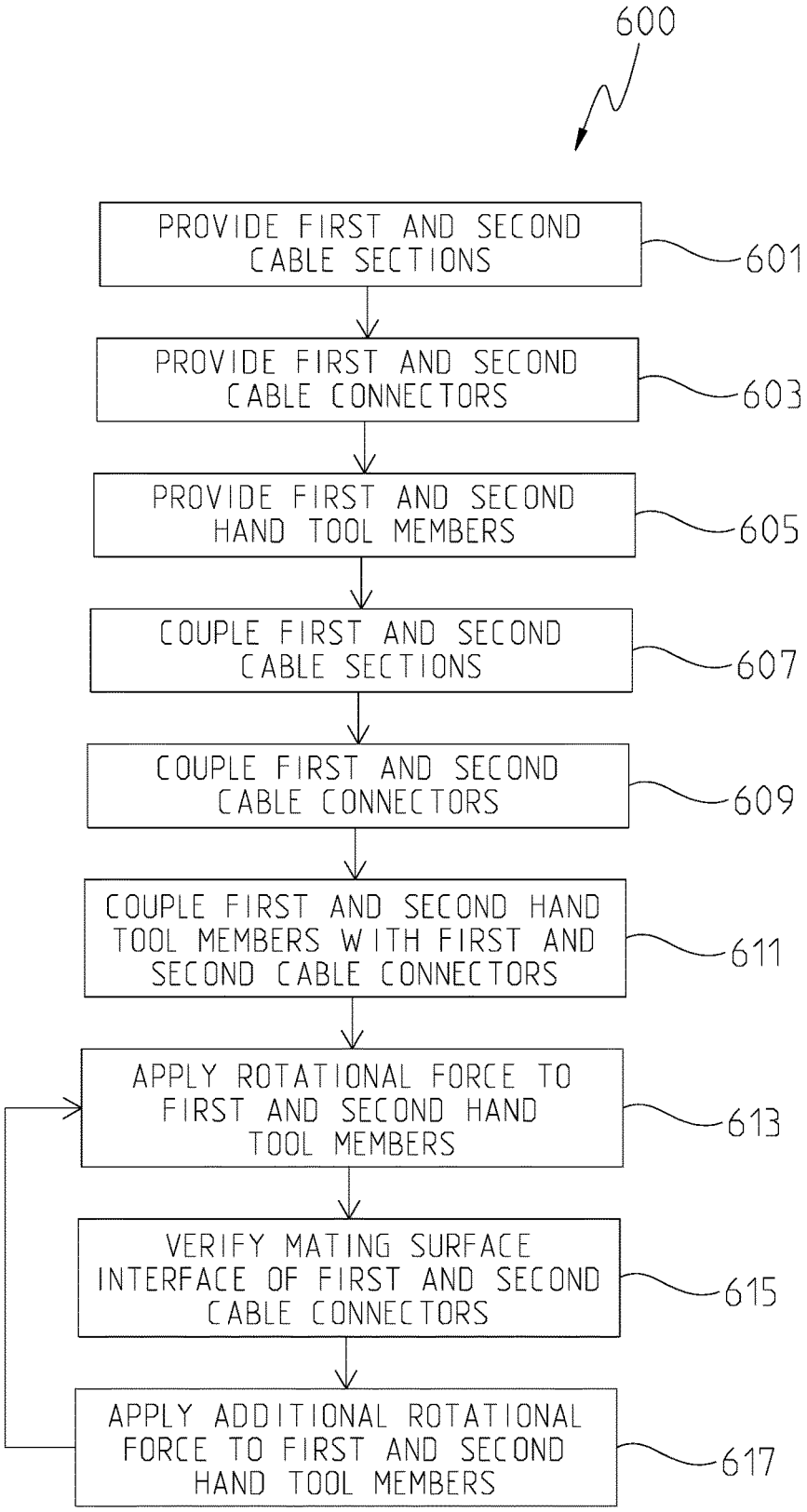
FIG. 14 is a flow chart of an illustrative method of use of the hand tool of the present disclosure.

With reference to FIGS. 2 and 14, an illustrative method 600 of using the hand tool 100 of the present disclosure includes providing first and second cable sections 10*a* and 10*b* including first and second cable connection portions 34 and 36 at block 601. The first and second cable sections 10*a* and 10*b* each include a diameter d2, and the first and second cable connection portions 34 and 36 each include first protrusion or ring wall 54 and 56 that extends radially outwardly from the respective first and second cable connection portion 34 and 36 and having a diameter d3 greater than the diameter d2. Block 603 includes providing first and second cable connectors 22*a* and 22*b*, each including a cylindrical body 64, 80 and a distal end 70, 86 including an inwardly extending lip 76, 90. The first and second cable connectors 22*a* and 22*b* include connector passageways 66 and 82 configured to receive and slide over the first and second cable sections 10*a* and 10*b*, wherein lips 76 and 90 engage with ring walls 54 and 56 of the cable connection sections 10*a* and 10*b*, respectively. The first and second cable connectors 22*a* and 22*b* include the plurality of second protrusions or keys 78 and 94 extending radially outwardly from the outer surfaces of the cylindrical bodies 64 and 80, respectively.

The method continues at block 605 by providing cable connector hand tool 100 including first and second hand tool members 102*a* and 102*b*. As further detailed herein, each hand tool member 102*a* and 102*b* includes body 104 having opening 108 in side section 106*d*, and first recessed area or portion 122 extending around center aperture or passageway 110 extending along central axis 117 of the body 104, and lip 124 surrounding the center passageway 110. The walls 76 and 90 of the cable connectors 22*a* and 22*b* move axially inwardly with the lips 124 of the hand tool members 102*a* and 102*b* so as to compress the first and second cable connection sections 10*a* and 10*b* together. The recessed portion 122 is formed with the plurality of recesses or keyways 125 adapted to couple with the plurality of protrusions or keys 78 and 94 of cable connectors 22*a* and 22*b*. The recessed portion 122 is further formed to have a shape and diameter configured to permit the first and second cable connectors 22*a* and 22*b* to pass into the recessed portion 122 with a non-interference fit and abut the lip 124. The recessed portion 122 is further formed to have depth dimension (r) measured along the central axis 117, such that each of the hand tool members 102*a* and 102*b* partially enclose distal ends of respective first and second cable connectors 22*a* and 22*b* such that interface 96 defined by the mating surfaces 74 and 92 is visible to an operator when the first and second cable sections 10*a* and 10*b* are fully coupled.

At block 607, the first and second cable sections 10*a* and 10*b* are coupled together as shown in FIG. 3. More particularly, the male portion or protrusion 51 is inserted within the female portion or socket 45, such that the sockets 52 receive the pins 46, defining an electrical connection therebetween. The method continues at block 609, where the first and second cable connectors 22*a* and 22*b* are coupled together as shown in FIG. 4. More particularly, the external threads 72 of connector 22*a* are rotated within the internal threads 88 of connector 22*b* such that the walls 76 and 90 move axially toward each other, thereby applying a compressive force against respective first protrusions or ring walls 54 and 56 of the first and second cable connection sections 34 and 36.

Continuing at block 611, the method continues by coupling the first and second hand tool members 102*a* and 102*b* with respective first and second cable connectors 22*a* and 22*b*. With reference to FIGS. 5 and 6, first and second cable sections 10*a* and 10*b* are passed through the first apertures or side openings 108 of the first and second hand tool members 102*a* and 102*b*, respectively. The first and second cable connectors 22*a* and 22*b* are engaged within the recessed portions 122, including keys 78 and 94 in the connector recesses 125. At block 613, rotational force is applied to the first and second hand tool members 102*a* and 102*b* and thereby tighten the first and second cable connectors 22*a* and 22*b* using manual application of force by hand of an operator wrapped around respective bodies 104. More particularly, at least two edges 106 of each body 104 are engaged by the fingers, thumb and/or palm of the operator's hand.

Continuing at block 615, the operator visually examines the mating surfaces 74 and 92 of the interface 96 visible between the first and second hand tool members 102*a* and 102*b* to verify they are in physical contact. At block 617, if the mating surfaces 74 and 92 of the interface 96 are not in physical contact, then the process returns to block 613 where additional rotational force is applied to the first and second hand tool members 102*a* and 102*b*. Proper mating surface contact at the interface 96 is again inspected at block 615.

While the above detailed description illustrates use of the hand tool 100 with electrical cables including a compression coupling, it should be appreciated that the hand tool may be used in other coupling applications. For example, the hand tool 100 may be used to couple fluid carrying tubes (e.g., water, gas and/or hydraulic fluid conduits), fiber optic cables, etc.

Figure 15:
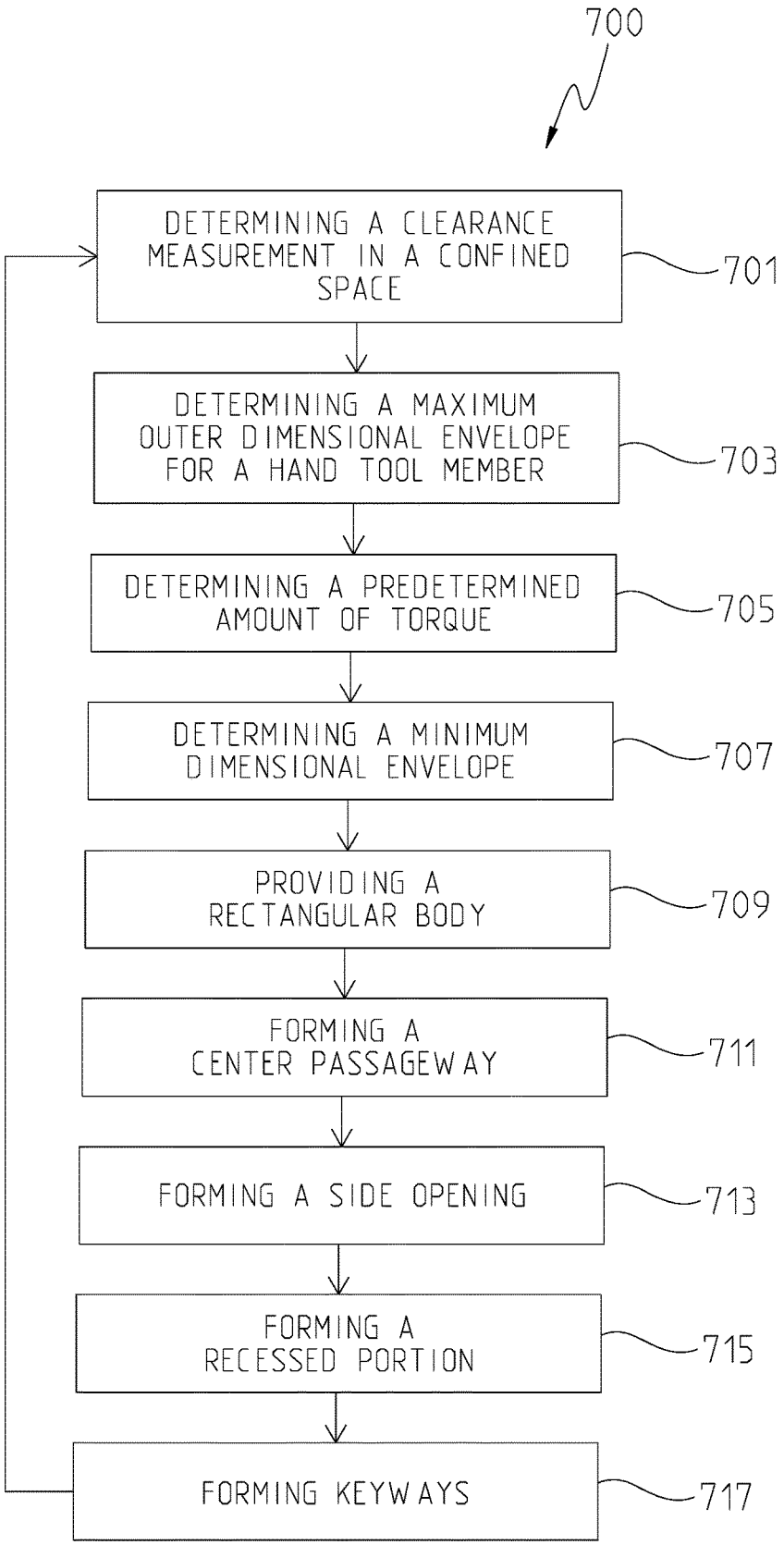
FIG. 15 is a flow chart of an illustrative method of manufacturing the hand tool of the present disclosure.

With reference to FIGS. 2 and 15, an illustrative method 700 of manufacturing the hand tool 100 of the present disclosure includes determining a clearance measurement in the confined space 20 at block 701. More particularly, the operator measures the area adjacent the connectors 22*a* and 22*b* within the confined space 20 to allow rotation of tool members 102*a* and 102*b* coupled to the connectors 22*a* and 22*b*. The method continues at block 703 by determining a maximum outer dimensional envelope for the hand tool members 102*a* and 102*b*. More particularly, the clearance measurement from the confined space 20 is used to determine the maximum outer dimensional envelope (i.e., the width (w) and height (h)) of rectangular body 104 of hand tool members 102*a* and 102*b*. At block 705, the method continues by determining a predetermined amount of torque required to fully seat the mating cable sections 10*a* and 10*b* in sealing compression.

The method continues at block 707 by determining a minimum dimensional envelope for hand tool members 102*a*, 102*b*. More particularly, the predetermined amount of torque and the injury force are used to determine the minimum dimensional envelope (i.e., the minimum width (w) and minimum height (h)) of rectangular body 104 of hand tool members 102*a* and 102*b*. The predetermined injury force associated with a shape and size of the first and second hand tool members 102*a* and 102*b* is based on a force that causes an abrasive or force application injury to an operator's hand using the hand tool a first plurality of times. The predetermined amount of torque, the average force of an operator, and the injury force are used to calculate the width (w) and height (h) of the rectangular body 104.

At block 709, the method continues by providing cable connector hand tool member 102*a*, 102*b* including rectangular body 104 formed with at least three flat edges 106. The first rectangular body 104 includes width (w) and height (h) configured to define a dimensional envelope between the maximum and minimum dimensional envelope as determined above in blocks 703 and 707. In one illustrative embodiment, the width (w) and height (h) of the rectangular body 104 are each determined to be 2.5 inches (FIG. 11). The shape and size of rectangular body 104 is configured to facilitate gripping by a user. As detailed above, at least two edges 106 of the body are planar, while the corners 120 are rounded to facilitate gripping while preventing injury to the operator.

At block 711, the method continues by forming center passageway 110 within rectangular body 104 and extending between opposing inner and outer surfaces 114 and 116, the center passageway 110 having a diameter configured to receive cable connector nut 22*a*, 22*b*. The method continues at block 713, by forming side opening 108 within side edge 106*d* of the rectangular body 104 and extending into the center passageway 110, the side opening 108 dimensioned to receive cable conduit portion 30.

At block 715, the method further includes forming recessed portion 122 within rectangular body 104 concentric to the center passageway 110 and having a diameter configured to define arcuate lip 124 for engaging distal wall 75, 93 of cable connector nut 22*a*, 22*b* the recessed portion 122 having a depth (r) such that mating surfaces 74, 92 of the cable connector nuts 22*a*, 22*b* are configured to extend beyond the inner surfaces 114 of the respective rectangular bodies 104. As further detailed above, the depth (r) is illustratively defined to be 0.38 inches (FIG. 12). The method continues at block 717 by forming keyways 125 within the recessed portion 122 to accommodate keys 78, 94 supported on the cable connector nut 22*a*, 22*b*.

Although the invention has been described in detail with reference to certain preferred embodiments, variations and modification exist within the spirit and scope of the invention as described and defined in the following claims.

The invention claimed is:

1. A method of manufacturing a hand tool for coupling together first and second cable sections, the method including the steps of:

determining a clearance measurement in a confined space receiving a cable connector assembly adapted to couple together mating cable sections including a plug and a socket;

wherein the cable connector assembly includes first and second cable connecting nuts, each of the cable connecting nuts formed with keys extending radially outwardly from an outer surface of the of the cable connecting nuts and including a threaded connecting portion, the threaded connecting portions of the first and second cable connecting nuts threadably engaging each other to couple together the plug and the socket of the mating cable sections by compressive force applied to the mating cable sections;

wherein the first and second cable connecting nuts are adapted to abut each other at mating surfaces when fully threadably engaged with each other;

wherein the cable connector assembly is located in the confined space such that the space does not permit use of a wrench with a handle for 360 degree rotation of the first and second cable connecting nuts; and determining, based on the clearance measurement, a maximum outer dimensional envelope for first and second hand tool members adapted to engage with the keys on the first and second cable connecting nuts and permit visibility of the mating surfaces of the first and second cable connecting nuts between the first and second hand tool members.

2. The method of claim 1, further comprising the steps of determining a predetermined amount of torque on the first and second hand tool members required to rotatably couple the first and second cable connecting nuts so as to fully engage the plug and the socket of the mating cable sections, and then determining a minimum dimensional envelope of the first and second hand tool members based on the predetermined torque and a predetermined injury force associated with a shape of the first and second hand tool members based on a force that causes an abrasive or force application injury to an operator's hand using the hand tool a first plurality of times.

3. The method of claim 2, further comprising the step of forming the first and second hand tool members based on the predetermined torque, the maximum outer dimensional envelope, the minimum dimensional envelope, and the predetermined injury force, wherein each of the first and second hand tool members comprises:

a rectangular body having flat side edges and rounded corners, the rectangular body having a width and a height configured to facilitate gripping by a user and application of the predetermined torque;

a center passageway within the rectangular body and extending between opposing inner and outer surfaces, the center passageway having a diameter configured to receive a respective one of the cable connector nuts; and a recessed portion within the rectangular body concentric to the center passageway to define an arcuate lip to engage a distal wall of the cable section, the recessed portion having a depth such that the mating surface of the cable section is configured to extend beyond the inner surface of the rectangular body.

* * * * *